US008555836B2

(12) United States Patent
David et al.

(10) Patent No.: US 8,555,836 B2
(45) Date of Patent: Oct. 15, 2013

(54) ELECTRIC DRIVE CAMSHAFT PHASER WITH TORQUE RATE LIMIT AT TRAVEL STOPS

(75) Inventors: Pascal David, Beidweiler (FR); Pierre Kimus, Attert (BE); Michael J. Fox, Stafford, NY (US); Daniel R. Cuatt, Rush, NY (US)

(73) Assignee: Delphi Technologies, Inc., Troy, MI (US)

( * ) Notice: Subject to any disclaimer, the term of this patent is extended or adjusted under 35 U.S.C. 154(b) by 501 days.

(21) Appl. No.: 12/965,057

(22) Filed: Dec. 10, 2010

(65) Prior Publication Data

US 2012/0145104 A1 Jun. 14, 2012

(51) Int. Cl.
*F01L 1/34* (2006.01)

(52) U.S. Cl.
USPC ..... 123/90.17; 123/90.15; 123/90.31

(58) Field of Classification Search
USPC ..... 123/90.15, 90.17, 90.31; 474/94
See application file for complete search history.

(56) References Cited

U.S. PATENT DOCUMENTS

| | | | | | |
|---|---|---|---|---|---|
| 306,267 | A | * | 10/1884 | La Turno | 464/67.1 |
| 447,447 | A | * | 3/1891 | Daily | 476/1 |
| 608,770 | A | * | 8/1898 | Godfray | 464/67.1 |
| 1,254,542 | A | * | 1/1918 | Schwinn | 464/67.1 |
| 1,518,360 | A | * | 12/1924 | Royce | 464/68.41 |
| 1,743,776 | A | * | 1/1930 | Hollnagel | 74/574.3 |
| 2,339,042 | A | * | 1/1944 | Anderson | 92/122 |
| 2,879,873 | A | * | 3/1959 | Spase | 192/104 C |
| 3,774,472 | A | * | 11/1973 | Mitchell | 74/574.2 |
| 4,139,995 | A | * | 2/1979 | Lamarche | 464/64.1 |
| 4,160,390 | A | * | 7/1979 | Spaetgens | 74/573.12 |
| 4,317,388 | A | * | 3/1982 | Wojcikowski | 74/574.2 |
| 4,715,247 | A | * | 12/1987 | Honda et al. | 74/640 |
| 4,817,504 | A | * | 4/1989 | Lieberman | 92/125 |
| 5,033,327 | A | * | 7/1991 | Lichti et al. | 74/568 R |
| 5,042,380 | A | * | 8/1991 | Quinci | 101/217 |
| 5,095,857 | A | * | 3/1992 | Hampton et al. | 123/90.17 |

(Continued)

FOREIGN PATENT DOCUMENTS

| | | | |
|---|---|---|---|
| DE | 102 58 724 | A1 * | 6/2004 |
| DE | 10 2006 060 676 | | 6/2008 |
| EP | 1895114 | A1 * | 3/2008 |

OTHER PUBLICATIONS

English translation of DE 102 58 724 A1.*

(Continued)

*Primary Examiner* — Kenneth Bomberg
*Assistant Examiner* — Jason T Newton
(74) *Attorney, Agent, or Firm* — Thomas N. Twomey

(57) ABSTRACT

A camshaft phaser controllably varies the phase relationship between a crankshaft and a camshaft in an internal combustion engine. The camshaft phaser includes an input member rotatable by the crankshaft. The input member is connected through a gear drive to an output member which is fixed to the camshaft. A rotational actuator acting on the gear drive unit causes relative rotation between the input member and the output member. A first stop member is rotatable with the input member in a one-to-one relationship. A second stop member is rotatable with the output member in a one-to-one relationship to limit relative angular travel between the input member and the output member. A torque absorption means is provided for limiting the rate at which torque is applied from the rotational actuator to the gear drive unit when the second stop member makes contact with the first stop member.

25 Claims, 11 Drawing Sheets

(56) References Cited

U.S. PATENT DOCUMENTS

| | | | | |
|---|---|---|---|---|
| 5,417,186 | A * | 5/1995 | Elrod et al. | 123/90.17 |
| 5,560,267 | A * | 10/1996 | Todd et al. | 74/604 |
| 5,579,665 | A * | 12/1996 | Mott et al. | 74/574.2 |
| 5,619,887 | A * | 4/1997 | Simpson | 74/574.2 |
| 5,836,276 | A * | 11/1998 | Iwasaki et al. | 123/90.17 |
| 6,053,139 | A * | 4/2000 | Eguchi et al. | 123/90.17 |
| 6,058,897 | A * | 5/2000 | Nakayoshi | 123/90.17 |
| 6,161,512 | A * | 12/2000 | Beels Van Heemstede | 123/90.31 |
| 6,234,127 | B1 * | 5/2001 | Simpson et al. | 123/90.31 |
| 6,283,076 | B1 * | 9/2001 | Simpson | 123/90.31 |
| 6,308,669 | B1 * | 10/2001 | Lancefield et al. | 123/90.15 |
| 6,308,678 | B1 * | 10/2001 | Haas et al. | 123/192.1 |
| 6,328,006 | B1 * | 12/2001 | Heer | 123/90.15 |
| 6,330,870 | B1 * | 12/2001 | Inoue et al. | 123/90.17 |
| 6,349,687 | B2 * | 2/2002 | Endeward | 123/90.31 |
| 6,361,460 | B1 * | 3/2002 | Rhee | 474/152 |
| 6,382,164 | B2 * | 5/2002 | Haas et al. | 123/192.1 |
| 6,390,043 | B1 * | 5/2002 | Niethammer et al. | 123/90.17 |
| 6,412,462 | B1 * | 7/2002 | Lichti et al. | 123/90.17 |
| 6,591,800 | B1 * | 7/2003 | Methley | 123/90.17 |
| 6,648,781 | B1 * | 11/2003 | Fischer et al. | 474/8 |
| 6,668,777 | B2 * | 12/2003 | Sluka et al. | 123/90.17 |
| 6,802,779 | B2 * | 10/2004 | Tabuchi et al. | 464/32 |
| 6,997,151 | B2 * | 2/2006 | Axmacher et al. | 123/90.17 |
| 7,341,029 | B2 * | 3/2008 | Stork et al. | 123/90.15 |
| 7,421,990 | B2 | 9/2008 | Taye et al. | |
| 7,452,281 | B2 * | 11/2008 | Nosaka et al. | 464/32 |
| 8,122,863 | B2 * | 2/2012 | Myers | 123/90.17 |
| 8,151,663 | B2 * | 4/2012 | Beutler et al. | 74/411 |
| 8,272,982 | B2 * | 9/2012 | Fitz | 474/94 |
| 8,292,766 | B2 * | 10/2012 | Cali et al. | 474/171 |
| 8,317,642 | B2 * | 11/2012 | Hartmann et al. | 474/94 |
| 8,322,318 | B2 * | 12/2012 | David et al. | 123/90.17 |
| 8,424,500 | B2 * | 4/2013 | David et al. | 123/90.17 |
| 8,424,676 | B2 * | 4/2013 | Jones et al. | 198/834 |
| 2002/0043231 | A1 * | 4/2002 | Hase | 123/90.15 |
| 2003/0217720 | A1 * | 11/2003 | Pierik et al. | 123/90.17 |
| 2003/0226532 | A1 * | 12/2003 | Takenaka et al. | 123/90.17 |
| 2004/0060379 | A1 * | 4/2004 | Bernhard et al. | 74/388 PS |
| 2004/0250648 | A1 * | 12/2004 | Chaugule | 74/574 |
| 2005/0188933 | A1 * | 9/2005 | Lipke et al. | 123/90.17 |
| 2006/0000435 | A1 * | 1/2006 | Aust et al. | 123/90.17 |
| 2007/0245991 | A1 * | 10/2007 | Weber | 123/90.17 |
| 2008/0047511 | A1 * | 2/2008 | Taye et al. | 123/90.17 |
| 2008/0083384 | A1 | 4/2008 | Morii | |
| 2008/0210182 | A1 * | 9/2008 | Schaefer et al. | 123/90.17 |
| 2010/0095919 | A1 * | 4/2010 | Myers et al. | 123/90.17 |
| 2010/0133060 | A1 * | 6/2010 | Boelling | 192/30 V |
| 2011/0277713 | A1 * | 11/2011 | David et al. | 123/90.15 |
| 2011/0315102 | A1 * | 12/2011 | David et al. | 123/90.15 |
| 2012/0291729 | A1 * | 11/2012 | David et al. | 123/90.15 |
| 2012/0312258 | A1 * | 12/2012 | Kimus et al. | 123/90.15 |
| 2013/0008398 | A1 * | 1/2013 | Stoltz-Douchet et al. | 123/90.15 |
| 2013/0019825 | A1 * | 1/2013 | Fischer | 123/90.15 |
| 2013/0095966 | A1 * | 4/2013 | Staley | 474/135 |

OTHER PUBLICATIONS

Pending U.S. Appl. No. 12/536,757, filed Aug. 6, 1909.
Pending U.S. Appl. No. 12/825,806, filed Jun. 29, 2010.
Pending U.S. Appl. No. 12/844,918, filed Jul. 28, 2010.
Pending U.S. Appl. No. 61/253,982, filed Oct. 22, 2009 (U.S. Appl. No. 12/848,599, filed Aug. 2, 2010).
Pending U.S. Appl. No. 61/333,775, filed May 12, 2010.
European Search Report Dated Feb. 23, 2012.

* cited by examiner

ELECTRIC DRIVE CAMSHAFT PHASER WITH TORQUE RATE LIMIT AT TRAVEL STOPS

TECHNICAL FIELD OF INVENTION

The present invention relates to an electric variable camshaft phaser (eVCP) which uses an electric motor and a harmonic drive unit to vary the phase relationship between a crankshaft and a camshaft in an internal combustion engine; more particularly to an eVCP with phase authority stops which limit the phase authority of the eVCP; and even more particularly to an eVCP with a torque absorption means for limiting the rate at which torque is applied from the electric motor to the harmonic drive unit as the phase authority stops makes contact with each other.

BACKGROUND OF INVENTION

Camshaft phasers for varying the timing of combustion valves in internal combustion engines are well known. A first element, known generally as a sprocket element, is driven by a chain, belt, or gearing from an engine's crankshaft. A second element, known generally as a camshaft plate, is mounted to the end of an engine's camshaft. A common type of camshaft phaser used by motor vehicle manufactures is known as a vane-type camshaft phaser. U.S. Pat. No. 7,421,989 shows a typical vane-type camshaft phaser which generally comprises a plurality of outwardly-extending vanes on a rotor interspersed with a plurality of inwardly-extending lobes on a stator, forming alternating advance and retard chambers between the vanes and lobes. Engine oil is supplied via a multiport oil control valve, in accordance with an engine control module, to either the advance or retard chambers, to change the angular position of the rotor relative to the stator, as required to meet current or anticipated engine operating conditions. In prior art camshaft phasers, the rotational range of phaser authority is typically about 50 degrees of camshaft rotation; that is, from a piston top-dead-center (TDC) position, the valve timing may be advanced to a maximum of about −40 degrees and retarded to a maximum of about +10 degrees. The phase authority of a vane-type camshaft phaser is inherently limited by the vanes of the rotor which will contact the lobes of the stator. Limiting the phase authority is important to prevent over-advancing and over-retarding which may, for example, result in undesired engine operation and engine damage due to interference of the engine valves and pistons.

While vane-type camshaft phasers are effective and relatively inexpensive, they do suffer from drawbacks. First, at low engine speeds, oil pressure tends to be low, and sometimes unacceptable. Therefore, the response of a vane-type camshaft phaser may be slow at low engine speeds. Second, at low environmental temperatures, and especially at engine start-up, engine oil displays a relatively high viscosity and is more difficult to pump, therefore making it more difficult to quickly supply engine oil to the vane-type camshaft phaser. Third, using engine oil to drive the vane-type camshaft phaser is parasitic on the engine oil system and can lead to requirement of a larger oil pump. Fourth, for fast actuation, a larger engine oil pump may be necessary, resulting in additional fuel consumption by the engine. Lastly, the total amount of phase authority provided by vane-type camshaft phasers is limited by the amount of space between adjacent vanes and lobes. A greater amount of phase authority may be desired than is capable of being provided between adjacent vanes and lobes.

For at least these reasons, the automotive industry is developing electrically driven camshaft phasers.

One type of electrically driven camshaft phaser being developed is shown in U.S. patent application Ser. No. 12/536,575; U.S. patent application Ser. No. 12/825,806; U.S. patent application Ser. No. 12/844,918; U.S. Provisional Patent Application Ser. No. 61/253,982; and U.S. Provisional Patent Application Ser. No. 61/333,775; which are commonly owned by Applicant and incorporated herein by reference in their entirety. The electrically driven camshaft phaser is an electric variable camshaft phaser (eVCP) which comprises a flat harmonic drive unit having a circular spline and a dynamic spline linked by a common flexspline within the circular and dynamic splines, and a single wave generator disposed within the flexspline. The circular spline is connectable to either of an engine camshaft or an engine crankshaft driven rotationally and fixed to a housing, the dynamic spline being connectable to the other thereof. The wave generator is driven selectively by an electric motor to cause the dynamic spline to rotate past the circular spline, thereby changing the phase relationship between the crankshaft and the camshaft. Unlike vane-type camshaft phasers in which the phase authority is inherently limited by interaction of the rotor and stator, there is no inherent limitation of the phase authority of the eVCP. The eVCP is also capable of provide a phase authority of 100 degrees or even more if desired for a particular engine application.

U.S. Pat. No. 7,421,990 discloses an eVCP comprising a harmonic drive unit. The eVCP of this example uses a phase range limiter that is bolted to the camshaft. The phase range limiter protrudes through an arcuate slot formed in a sprocket wheel. The two ends of the arcuate slot constrain movement of the phase range limiter and thereby limit phase authority of the eVCP. This phase range limiter suffers from several drawbacks. First, this arrangement for limiting the phase authority of the eVCP requires additional components and assembly time. Second, since the phase range limiter is external to the eVCP, it may be susceptible to damage which would affect the phase authority of the eVCP. Third, when the phase range limiter contacts an end of the arcuate slot, the impact may causes torque to be applied at a high rate to the harmonic drive unit which may undesirably affect the harmonic drive unit. In other words the magnitude of torque increases greatly in a short period of time.

What is needed is an eVCP with means for limiting the phase authority of the eVCP. What is also needed is a robust means for limiting the phase authority of the eVCP which limits the rate at which torque is applied to the harmonic drive unit when the stop members contact each other.

SUMMARY OF THE INVENTION

Briefly described, a camshaft phaser is provided for controllably varying the phase relationship between a crankshaft and a camshaft in an internal combustion engine. The camshaft phaser includes a housing having a bore with a longitudinal axis and a harmonic gear drive unit is disposed therein. The harmonic gear drive unit includes a circular spline and a dynamic spline, a flexspline disposed within the circular spline and the dynamic spline, a wave generator disposed within the flexspline, and a rotational actuator connectable to the wave generator. One of the circular spline and the dynamic spline is fixed to the housing in order to prevent relative rotation therebetween. A hub is rotatably disposed within the housing and attachable to the camshaft and fixed to the other of the circular spline and the dynamic spline in order to prevent relative rotation therebetween. A first stop member is provided which is rotatable with the circular spline in a one-to-one relationship. A second stop member is also provided which is rotatable with the dynamic spline in a one-to-one relationship for contacting the first stop member to limit relative angular travel between the circular spline and the dynamic spline when the camshaft phaser is phasing the camshaft in one of an advance direction and a retard direction. A torque absorption means limits the rate at which torque is applied from the rotational actuator to the harmonic drive gear unit as the second stop member makes contact with the first stop member.

BRIEF DESCRIPTION OF DRAWINGS

This invention will be further described with reference to the accompanying drawings in which.

DETAILED DESCRIPTION OF INVENTION

Figure 1:
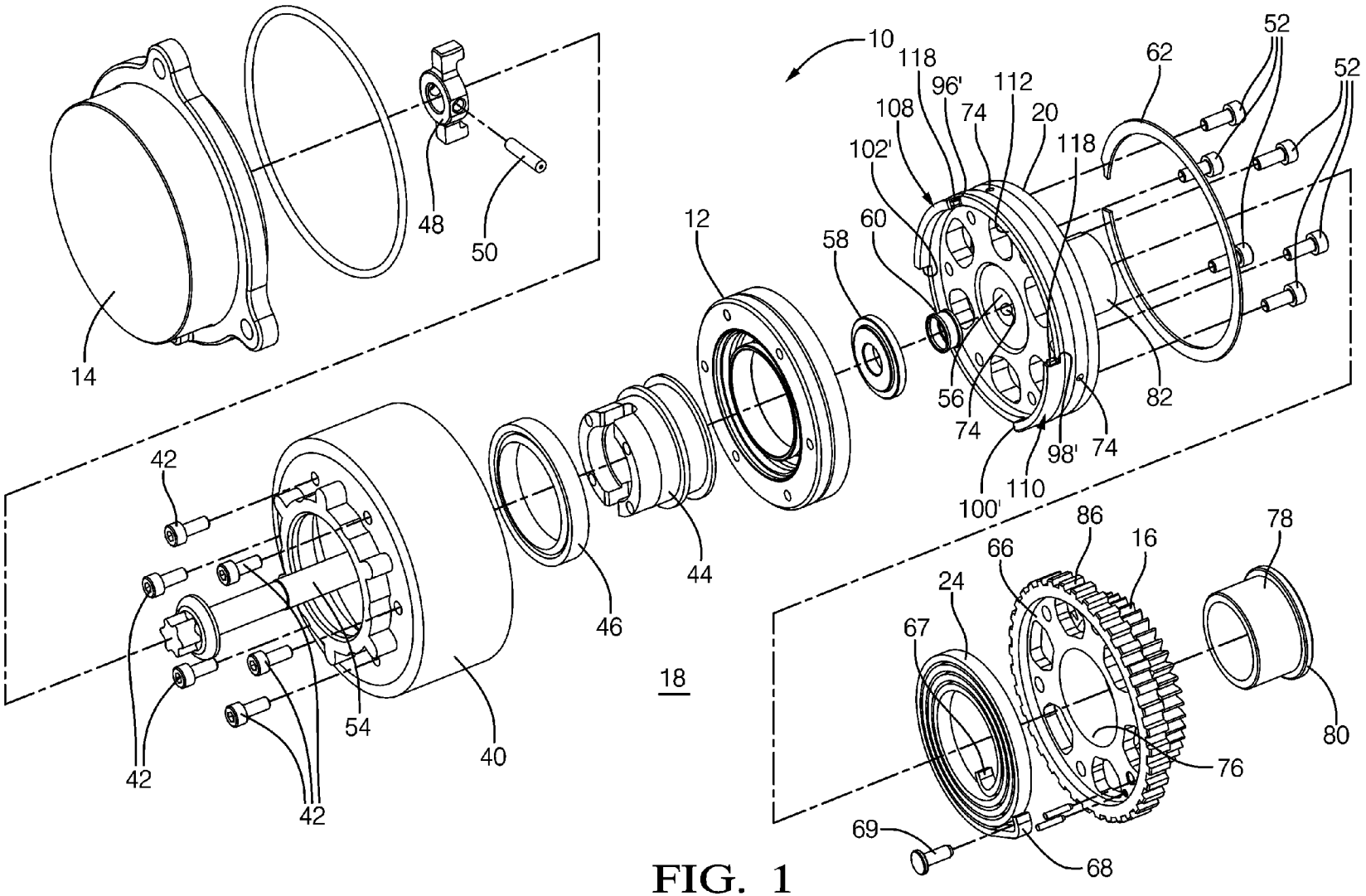
FIG. 1 is an exploded isometric view of an eVCP in accordance with the present invention.
Figure 2:
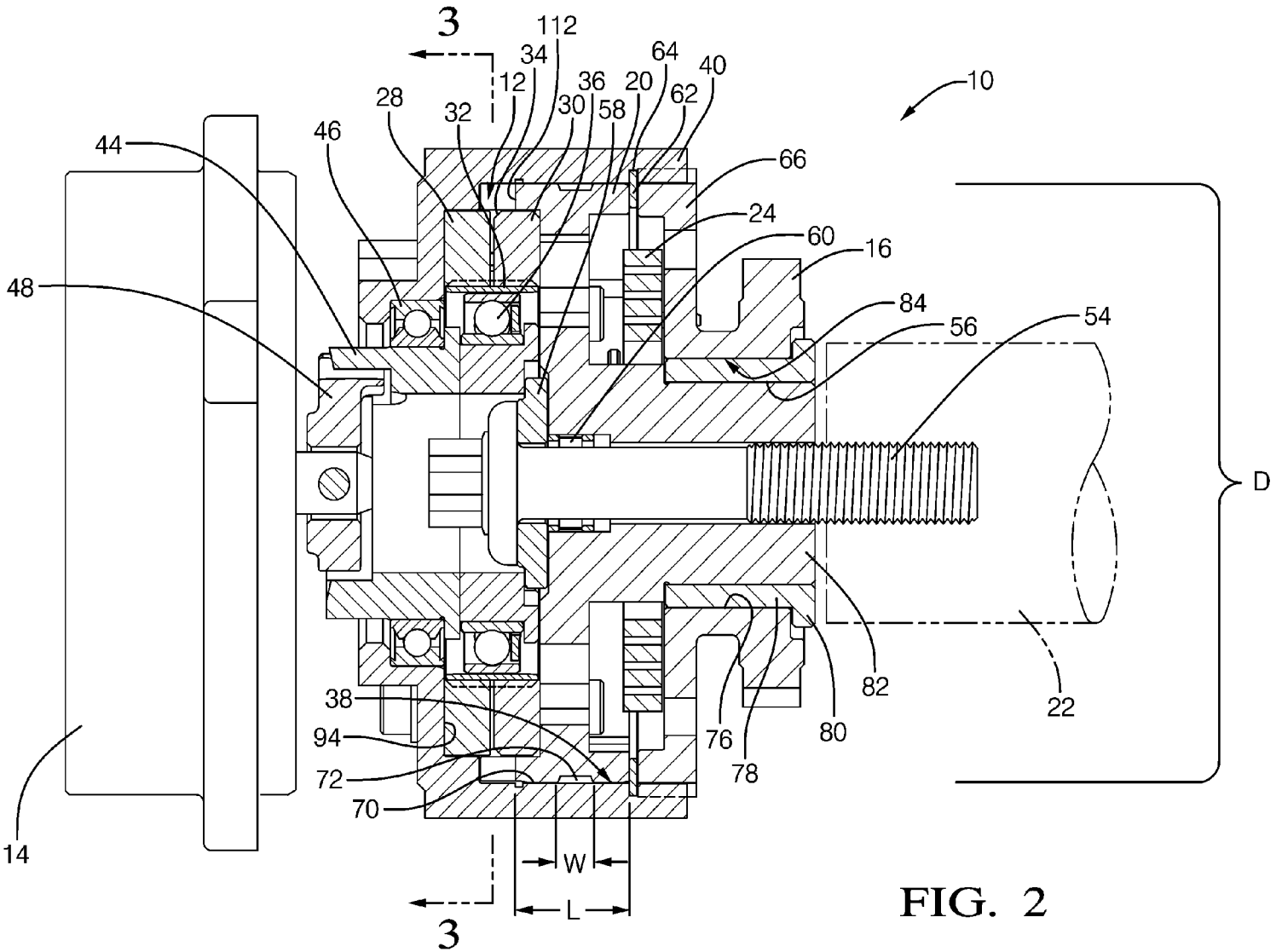
FIG. 2 is an axial cross-section of an eVCP in accordance with the present invention.

Referring to FIGS. 1 and 2, an eVCP 10 in accordance with the present invention comprises a flat harmonic gear drive unit 12; a rotational actuator 14 that may be a hydraulic motor but is preferably a DC electric motor, operationally connected to harmonic gear drive unit 12; an input sprocket 16 operationally connected to harmonic gear drive unit 12 and drivable by a crankshaft (not shown) of engine 18; an output hub 20 attached to harmonic gear drive unit 12 and mountable to an end of an engine camshaft 22; and a bias spring 24 operationally disposed between output hub 20 and input sprocket 16. Electric motor 14 may be an axial-flux DC motor.

Harmonic gear drive unit 12 comprises an outer first spline 28 which may be either a circular spline or a dynamic spline as described below; an outer second spline 30 which is the opposite (dynamic or circular) of first spline 28 and is coaxially positioned adjacent first spline 28; a flexspline 32 disposed radially inwards of both first and second splines 28, 30 and having outwardly-extending gear teeth disposed for engaging inwardly-extending gear teeth on both first and second splines 28, 30; and a wave generator 36 disposed radially inwards of and engaging flexspline 32.

Flexspline 32 is a non-rigid ring with external teeth on a slightly smaller pitch diameter than the circular spline. It is fitted over and elastically deflected by wave generator 36.

The circular spline is a rigid ring with internal teeth engaging the teeth of flexspline 32 across the major axis of wave generator 36. The circular spline serves as the input member.

The dynamic spline is a rigid ring having internal teeth of the same number as flexspline 32. It rotates together with flexspline 32 and serves as the output member. Either the dynamic spline or the circular spline may be identified by a chamfered corner 34 at its outside diameter to distinguish one spline from the other.

As is disclosed in the prior art, wave generator 36 is an assembly of an elliptical steel disc supporting an elliptical bearing, the combination defining a wave generator plug. A flexible bearing retainer surrounds the elliptical bearing and engages flexspline 32. Rotation of the wave generator plug causes a rotational wave to be generated in flexspline 32 (actually two waves 180° apart, corresponding to opposite ends of the major ellipse axis of the disc).

During assembly of harmonic gear drive unit 12, flexspline teeth engage both circular spline teeth and dynamic spline teeth along and near the major elliptical axis of the wave generator. The dynamic spline has the same number of teeth as the flexspline, so rotation of the wave generator causes no net rotation per revolution therebetween. However, the circular spline has slightly fewer gear teeth than does the dynamic spline, and therefore the circular spline rotates past the dynamic spline during rotation of the wave generator plug, defining a gear ratio therebetween (for example, a gear ratio of 50:1 would mean that 1 rotation of the circular spline past the dynamic spline corresponds to 50 rotations of the wave generator). Harmonic gear drive unit 12 is thus a high-ratio gear transmission; that is, the angular phase relationship between first spline 28 and second spline 30 changes by 2% for every revolution of wave generator 36.

Of course, as will be obvious to those skilled in the art, the circular spline rather may have slightly more teeth than the dynamic spline has, in which case the rotational relationships described below are reversed.

Still referring to FIGS. 1 and 2, input sprocket 16 is fixed to a generally cup-shaped sprocket housing 40 that is fastened by bolts 42 to first spline 28 in order to prevent relative rotation therebetween. Coupling adaptor 44 is mounted to wave generator 36 and extends through sprocket housing 40, being supported by bearing 46 mounted in sprocket housing 40. Coupling adapter 44 may be made of two separate pieces that are joined together as shown in FIG. 2. Coupling 48, mounted to the motor shaft of electric motor 14 and pinned thereto by pin 50, engages coupling adaptor 44, permitting wave generator 36 to be rotationally driven by electric motor 14, as may be desired to alter the phase relationship between first spline 28 and second spline 30.

Output hub 20 is fastened to second spline 30 by bolts 52 and may be secured to engine camshaft 22 by central through-bolt 54 extending through output hub axial bore 56 in output hub 20, and capturing stepped thrust washer 58 and filter 60 recessed in output hub 20. In an eVCP, it is necessary to limit radial run-out between the input hub and output hub. In the prior art, this has been done by providing multiple roller bearings to maintain concentricity between the input and output hubs. Referring to FIG. 2, radial run-out is limited by a single journal bearing interface 38 between sprocket housing 40 (input hub) and output hub 20, thereby reducing the overall axial length of eVCP 10 and its cost to manufacture. Output hub 20 is retained within sprocket housing 40 by snap ring 62 disposed in an annular groove 64 formed in sprocket housing 40.

Back plate 66, which is integrally formed with input sprocket 16, captures bias spring 24 against output hub 20.

Inner spring tang 67 is engaged by output hub 20, and outer spring tang 68 is attached to back plate 66 by pin 69. In the event of an electric motor malfunction, bias spring 24 is biased to back-drive harmonic gear drive unit 12 without help from electric motor 14 to a rotational position of second spline 30 wherein engine 18 will start or run, which position may be at one of the extreme ends of the range of authority or intermediate of the phaser's extreme ends of its rotational range of authority. For example, the rotational range of travel in which bias spring 24 biases harmonic gear drive unit 12 may be limited to something short of the end stop position of the phaser's range of authority. Such an arrangement would be useful for engines requiring an intermediate park position for idle or restart.

The nominal diameter of output hub 20 is D; the nominal axial length of first journal bearing 70 is L; and the nominal axial length of the oil groove 72 formed in either output hub 20 (shown) and/or in sprocket housing 40 (not shown) for supplying oil to first journal bearing 70 is W. In addition to journal bearing clearance, the length L of the journal bearing in relation to output hub diameter D controls how much output hub 20 can tip within sprocket housing 40. The width of oil groove 72 in relation to journal bearing length L controls how much bearing contact area is available to carry the radial load. Experimentation has shown that a currently preferred range of the ratio L/D may be between about 0.25 and about 0.40, and that a currently preferred range of the ratio W/L may be between about 0.15 and about 0.70.

Oil provided by engine 18 is supplied to oil groove 72 by one or more oil passages 74 that extend radially from output hub axial bore 56 of output hub 20 to oil groove 72. Filter 60 filters contaminants from the incoming oil before entering oil passages 74. Filter 60 also filters contaminants from the incoming oil before being supplied to harmonic gear drive unit 12 and bearing 46. Filter 60 is a band-type filter that may be a screen or mesh and may be made from any number of different materials that are known in the art of oil filtering.

Extension portion 82 of output hub 20 receives bushing 78 in a press fit manner. In this way, output hub 20 is fixed to bushing 78. Input sprocket axial bore 76 interfaces in a sliding fit manner with bushing 78 to form second journal bearing 84. This provides support for the radial drive load placed on input sprocket 16 and prevents the radial drive load from tipping first journal bearing 70 which could cause binding and wear issues for first journal bearing 70. Bushing 78 includes radial flange 80 which serves to axially retain back plate 66/input sprocket 16. Alternatively, but not shown, bushing 78 may be eliminated and input sprocket axial bore 76 could interface in a sliding fit manner with extension portion 82 of output hub 20 to form second journal bearing 84 and thereby provide the support for the radial drive load placed on input sprocket 16. In this alternative, back plate 66/input sprocket 16 may be axially retained by a snap ring (not shown) received in a groove (not shown) of extension portion 82.

Figure 5:
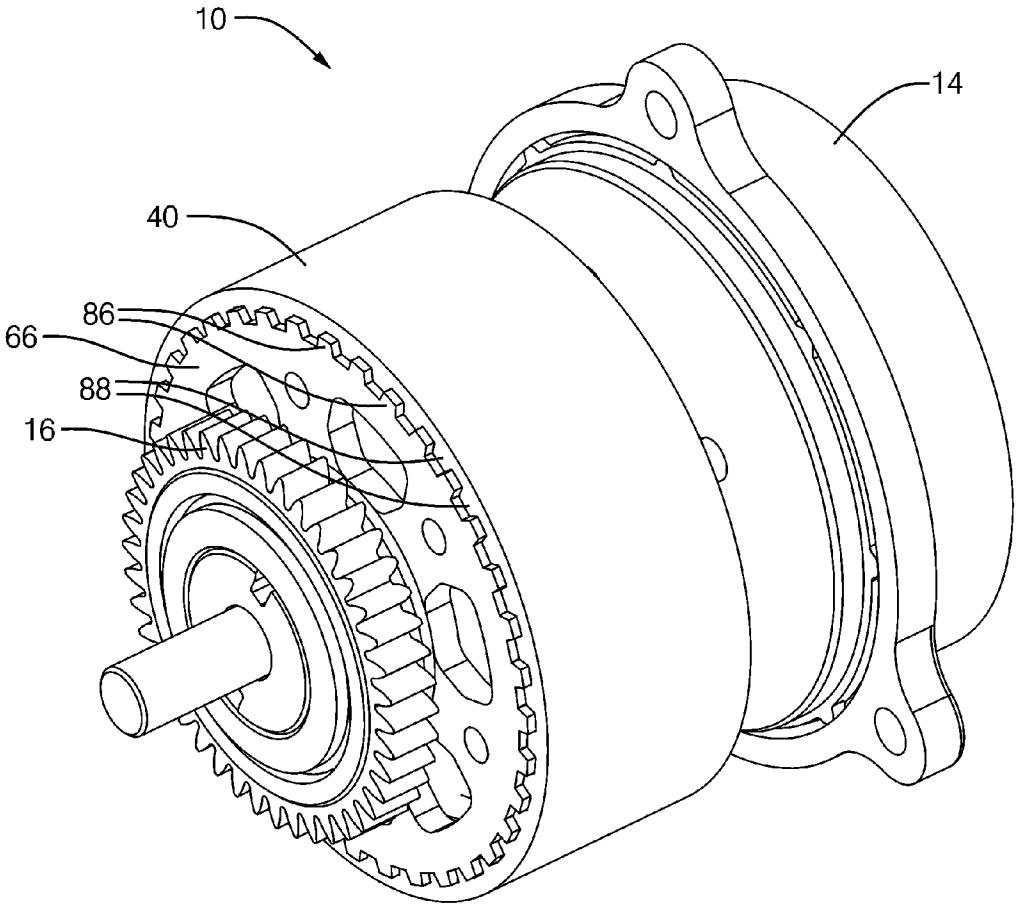
FIG. 5 is an isometric view of an eVCP in accordance with the present invention.

In order to transmit torque from input sprocket 16/back plate 66 to sprocket housing 40 and referring to FIGS. 1, 2, and 5, a sleeve gear type joint is used in which back plate 66 includes external splines 86 which slidingly fit with internal splines 88 included within sprocket housing 40. The sliding fit nature of the splines 86, 88 eliminates or significantly reduces the radial tolerance stack issue between first journal bearing 70 and second journal bearing 84 because the two journal bearings 70, 84 operate independently and do not transfer load from one to the other. If this tolerance stack issue were not resolved, manufacture of the two journal bearings would be prohibitive in mass production because of component size and concentricity tolerances that would need to be maintained. The sleeve gear arrangement also eliminates then need for a bolted flange arrangement to rotationally fix back plate 66 to sprocket housing 40 which minimizes size and mass. Additionally, splines 86, 88 lend themselves to fabrication methods where they can be net formed onto back plate 66 and into sprocket housing 40 respectively. Splines 86, 88 may be made, for example, by powder metal process or by standard gear cutting methods.

Figure 3A:
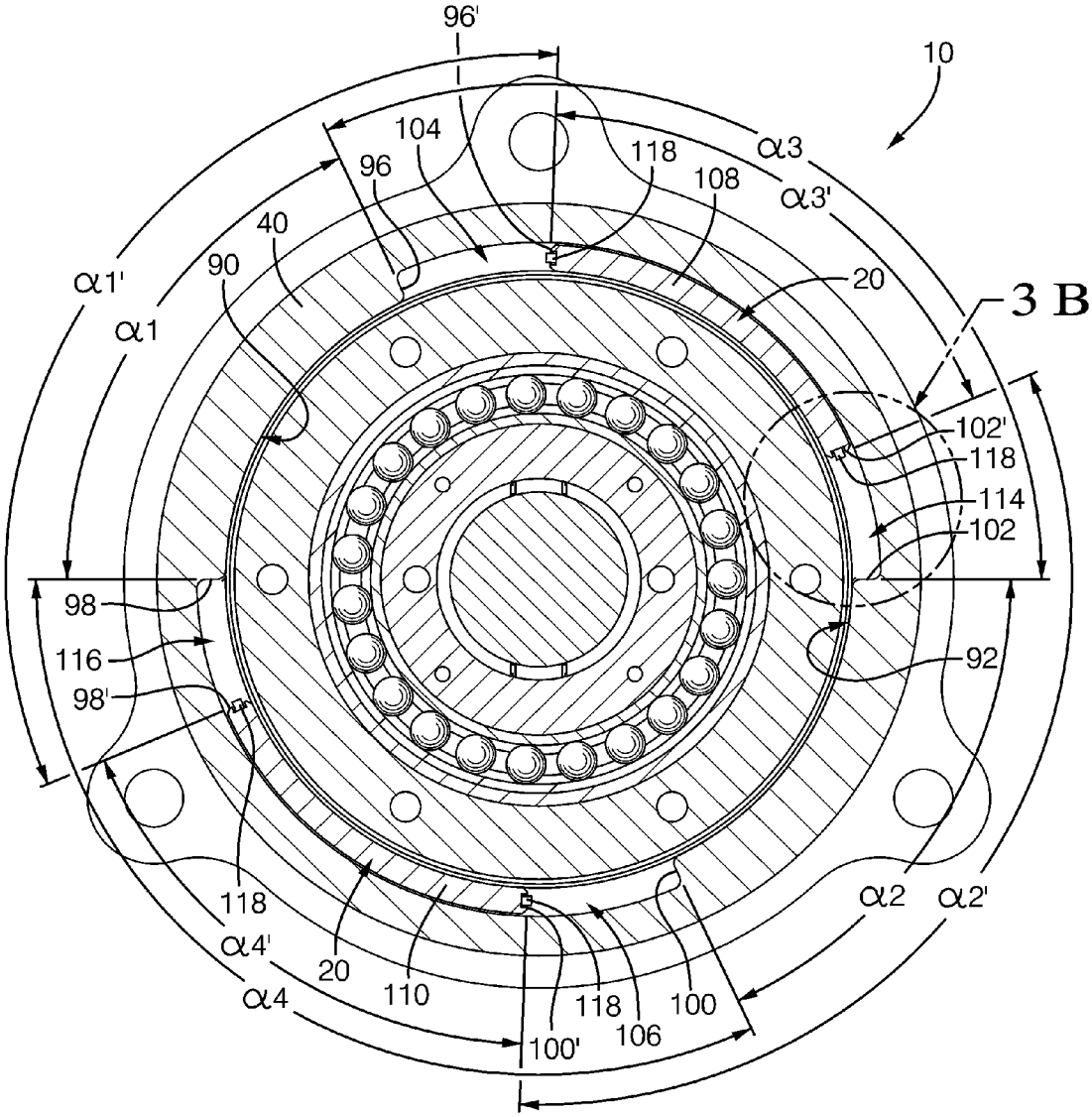
FIG. 3A is a radial cross-section through line 3-3 of FIG. 2.
Figure 4:
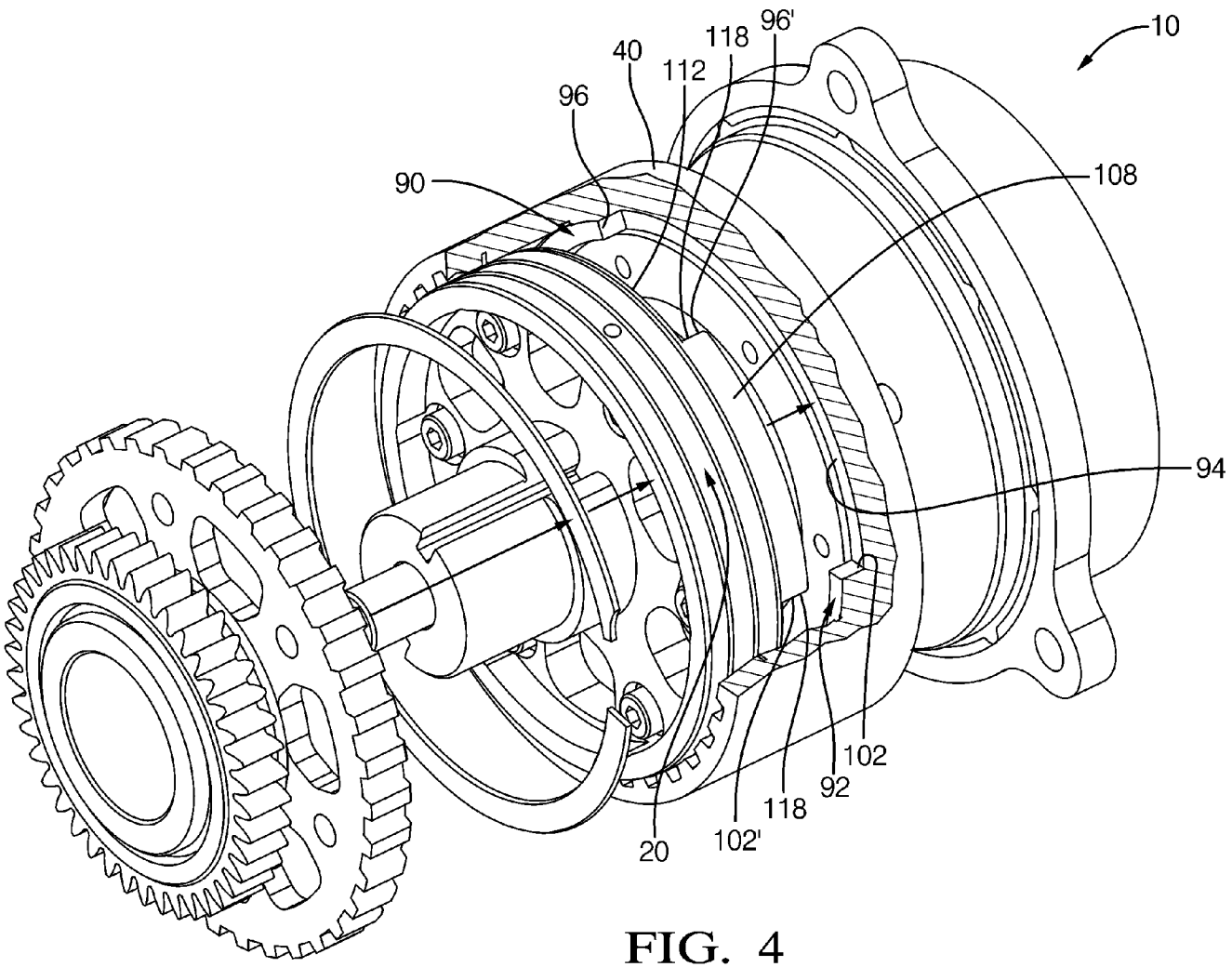
FIG. 4 is an exploded isometric partial cut-away view of an eVCP in accordance with the present invention.

Now referring to FIGS. 3A and 4, eVCP 10 is provided with a means for limiting the phase authority, or angular travel, of eVCP 10. Sprocket housing 40 is provided with first and second arcuate input stop members 90, 92 which extend axially away from first surface 94 (also shown in FIG. 2) of sprocket housing 40, the first and second lengths of which are defined by the arcuate or angular distances $\alpha 1$, $\alpha 2$ respectively. First surface 94 is the bottom of the longitudinal bore which receives output hub 20 within sprocket housing 40. First arcuate input stop member 90 includes first advance stop surface 96 and first retard stop surface 98 which define the ends of first arcuate input stop member 90. Similarly, second arcuate input stop member 92 includes second advance stop surface 100 and second retard stop surface 102 which define the ends of second arcuate input stop member 92. First arcuate input opening 104 is defined between first advance stop surface 96 of first arcuate input stop member 90 and second retard stop surface 102 of second arcuate input stop member 92. First arcuate input opening 104 has a third length defined by the arcuate or angular distance $\alpha 3$. Similarly, second arcuate input opening 106 is defined between first retard stop surface 98 of first arcuate input stop member 90 and second advance stop surface 100 of second arcuate input stop member 92. Second arcuate input opening 106 has a fourth length defined by the arcuate or angular distance $\alpha 4$.

Now referring to FIGS. 1, 3A, 3B, and 4, output hub 20 includes corresponding features which interact with first and second arcuate input stop members 90, 92 and first and second arcuate input openings 104, 106 to limit the phase authority of eVCP 10. Output hub 20 is provided with first and second arcuate output stop members 108, 110 which extend axially away from second surface 112 (also shown in FIG. 2) of output hub 20, the fifth and sixth lengths of which are defined by the arcuate or angular distances $\alpha 3'$, $\alpha 4'$ respectively. Second surface 112 is the end of output hub 20 which faces toward first surface 94. First arcuate output stop member 108 includes third advance stop surface 96' and fourth retard stop surface 102' which define the ends of first arcuate output stop member 108. Similarly, second arcuate output stop member 110 includes fourth advance stop surface 100' and third retard stop surface 98' which define the ends of second arcuate output stop member 110. First arcuate output opening 114 is defined between fourth retard stop surface 102' of first arcuate output stop member 108 and fourth advance stop surface 100' of second arcuate output stop member 110. First arcuate output opening 114 has a seventh length defined by the arcuate or angular distance $\alpha 2'$. Similarly, second arcuate output opening 116 is defined between third retard stop surface 98' of second arcuate output stop member 110 and third advance stop surface 96' of first arcuate output stop member 108. Second arcuate output opening 116 has an eighth length defined by the arcuate or angular distance $\alpha 1'$.

In order to establish the phase authority of eVCP 10, first and second arcuate input stop members 90, 92 are axially and radially received within second and first arcuate output openings 116, 114 respectively. Similarly, first and second arcuate output stop members 108, 110 are axially and radially received within first and second arcuate input openings 104, 106 respectively. The arcuate stop members and each corresponding arcuate opening within which the arcuate stop member is received are sized such that the angular distance of each angular opening minus the angular distance of the corresponding arcuate stop member is equal to the phase authority of eVCP 10. For example, angular distance $\alpha$1' minus angular distance $\alpha$1 equals the phase authority of eVCP. Stated another way, if the phase authority for eVCP is 50 degrees, then angular distance $\alpha$1' (in degrees) minus angular distance $\alpha$1 (in degrees) equals 50 degrees.

Angular distances $\alpha$1, $\alpha$2 of first and second arcuate input stop members 90, 92 are preferably equal and first and second arcuate input stop members 90, 92 are preferably angularly spaced in a symmetric manner. Similarly, angular distance $\alpha$3', $\alpha$4' of first and second arcuate output stop members 108, 110 are preferably equal and first and second arcuate output stop members 108, 110 are preferably angularly spaced in a symmetric manner. As can now be seen, distinct eVCPs can be provided for different engine application requiring different amounts of phase authority simply by redesigning the input stop members and the output stop members to achieve the desired phase authority.

Angular distances $\alpha$3, $\alpha$4 of first and second arcuate input openings 104, 106 are preferably equal and first and second arcuate input openings 104, 106 are preferably angularly spaced in a symmetric manner. Similarly, angular distance $\alpha$1', $\alpha$2' of first and second arcuate output openings 114, 116 are preferably equal and first and second arcuate output openings 114, 116 are preferably angularly spaced in a symmetric manner.

A torque absorption means may be provided in order to limit the rate at which torque is applied from electric motor 14 to wave generator 36 and consequently through harmonic gear drive unit 12. In other words, the torque absorption means extends the period of time over which the magnitude of torque is increased. In FIGS. 1, 2, 3A, and 3B, the torque absorption means takes the form of bumpers 118 that are fixed to and extend away from third and fourth advance stop surfaces 96', 100' and third and fourth retard stop surfaces 98', 102'. Bumpers 118 are made of a material that is resilient and compliant and include a first cross-sectional area in an uncompressed state where the cross-sectional area is viewed in the direction of arrow 120. Bumpers 118 may be received in recesses 122 formed in third and fourth advance stop surfaces 96', 100' and third and fourth retard stop surfaces 98', 102'. Recesses 122 each have a second cross-sectional area, as viewed in the direction of arrow 120, that is larger than the first cross-sectional area. The larger second cross-sectional area of recesses 122 compared to the cross-sectional area of bumpers 118 allows bumpers 118 to compress, thereby deforming into the remaining volume of recesses 122 when any of the third and fourth advance stop surfaces 96', 100' and third and fourth retard stop surfaces 98', 102' are brought into contact with corresponding first and second advance stop surfaces 96, 100 and first and second retard stop surfaces 98, 102. In this way, the rate at which torque is applied from electric motor 14 to harmonic gear drive unit 12 is limited when corresponding stop surfaces contact each other.

Figure 6:
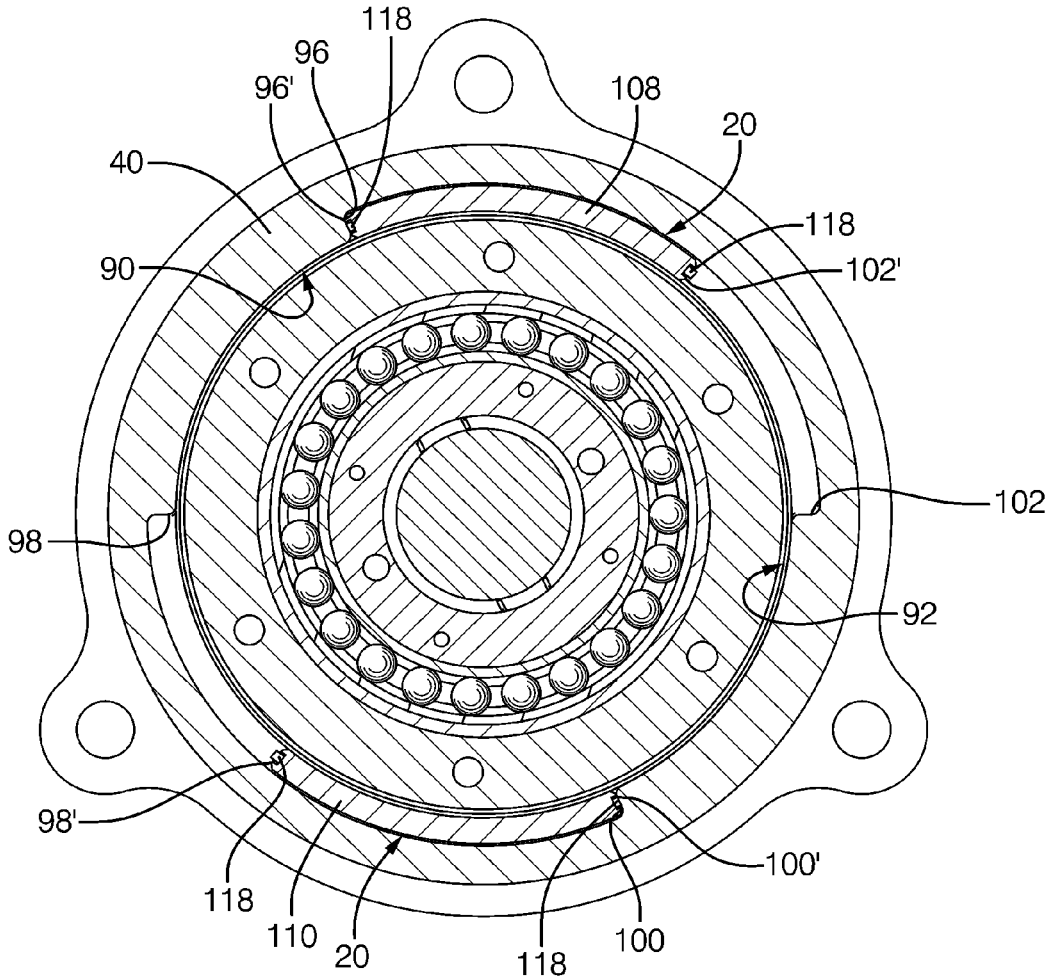
FIG. 6 is a radial cross-section as in FIG. 3A now shown in the maximum advance valve timing position.
Figure 7:
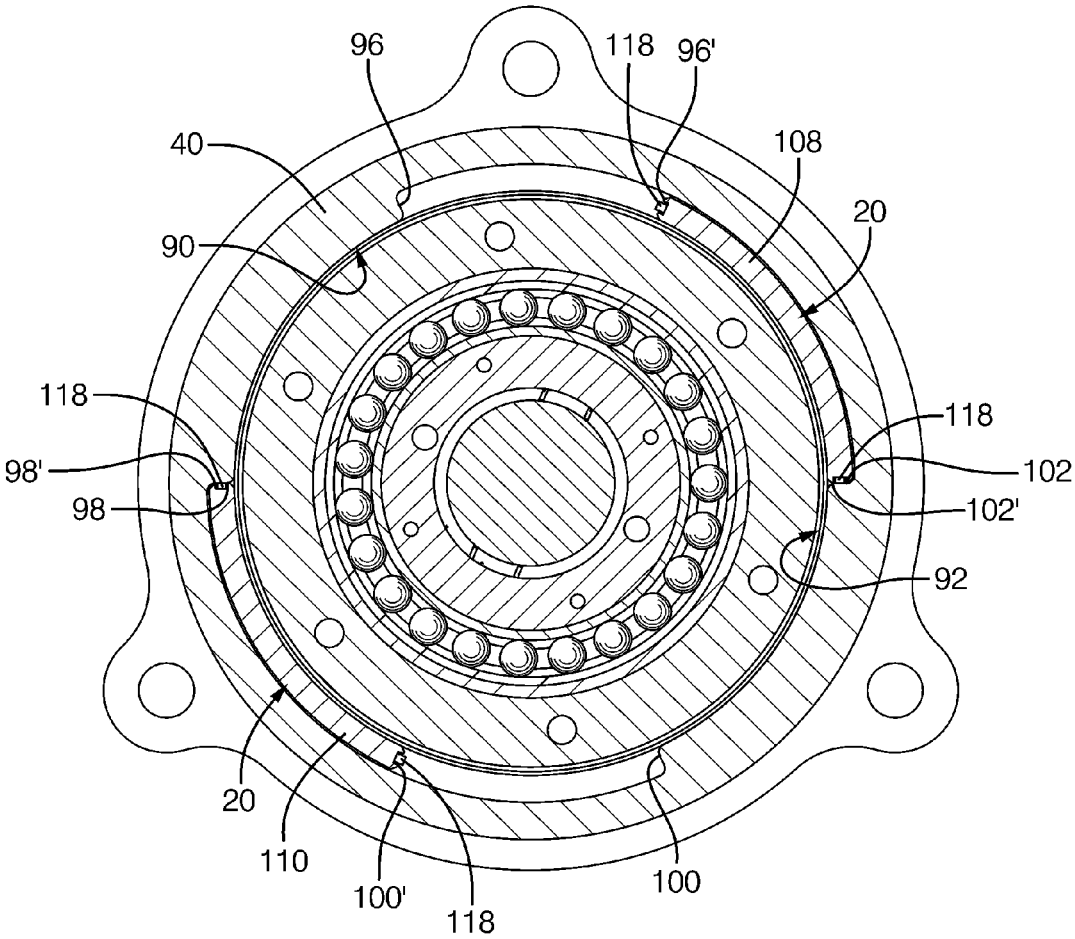
FIG. 7 is a radial cross-section as in FIG. 3A, now shown in the maximum retard valve timing position.

In operation, electric motor 14 may actuate harmonic gear drive unit 12 to rotate output hub 20 with respect to sprocket housing 40 until first and third advance stop surfaces 96, 96' are in contact with each other as shown in FIG. 6. At the same time, second and fourth advance stop surfaces 100, 100' are in contact with each other. Bumpers 118 have now been compressed and have dampened the impact as the stop surfaces contact each other by extending the period of time over which the magnitude of torque is increased. Similarly, electric motor 14 may actuate harmonic gear drive unit 12 to rotate output hub 20 with respect to sprocket housing 40 until second and fourth retard stop surfaces 102, 102' are in contact with each other as shown in FIG. 7. At the same time, first and third retard stop surfaces 98, 98' are in contact with each other. Bumpers 118 have now been compressed and have dampened the impact as the stop surfaces contact each other by extending the period of time over which the magnitude of torque is increased.

Figure 3D:
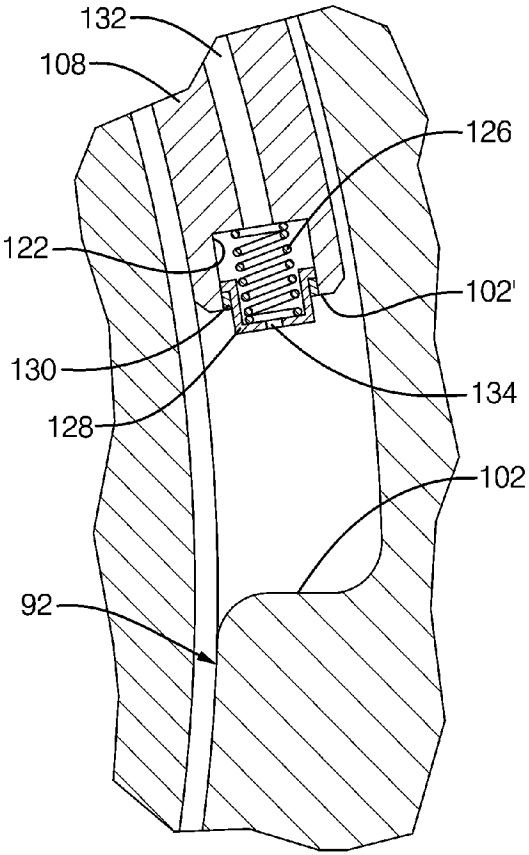
FIG. 3D is an alternate pair of stop members of FIG. 3C.
Figure 3C:
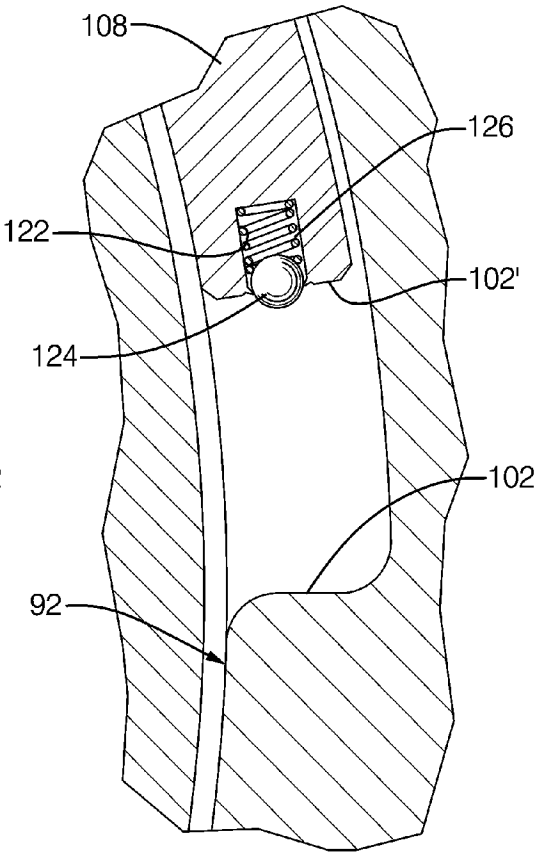
FIG. 3C is an alternate pair of stop members of FIG. 3B.
Figure 3B:
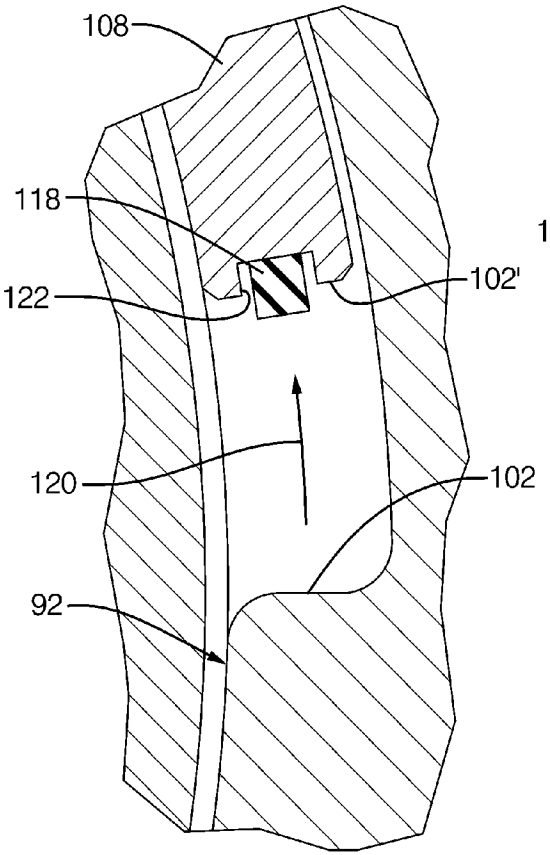
FIG. 3B is an enlarged view of one pair of stop members of FIG. 3A.

Now referring to FIG. 3C, a first alternative to bumpers 118 is provided. In FIG. 3C, bumper 118 is replaced with a plunger illustrated as ball 124 which is received within recess 122 in a slip fit manner. Ball 124 is retained within recess 122 by known methods such as a retention clip (not shown) or mechanical deformation of the material at the open end of recess 122 which is commonly known as a stake. Ball 124 is biased in an outward direction of recess 122 by spring 126. When second retard stop surface 102 is not in contact with ball 124, ball 124 partially protrudes from recess 122 as a result of the force exerted by spring 126. However, if fourth retard stop surface 102' is brought into contact with second retard stop surface 102, spring 126 will be compressed and ball 124 will be entirely within recess 122. Although not shown, ball 124 could alternatively be a cylindrical piston which functions in the same manner. In this way, the rate at which torque is applied from electric motor 14 to harmonic gear drive unit 12 is limited by extending the period of time over which the magnitude of torque is increased.

Now referring to FIG. 3D, a second alternative to bumper 118 is provided. In FIG. 3D, bumper 118 is replaced with piston 128 received within recess 122 in a slip fit manner. Piston 128 may be cup shaped, and is retained with retaining ring 130 which may be press fit within recess 122. Recess 122 includes oil supply orifice 132 in the closed end thereof for supplying oil to the volume between piston 128 and recess 122. Oil supply orifice 132 may receive oil, for example, through an oil gallery (not shown) that is in fluid communication with oil passage 74. Piston 128 may include bleed hole 134 through the closed end thereof which is sized to flow enough oil to keep the volume between piston 128 and recess 122 void of air. Piston 128 is biased in an outward direction of recess 122 by spring 126. When second retard stop surface 102 is not in contact with piston 128, piston 128 partially protrudes from recess 122 as a result of the force exerted by spring 126. However, if fourth retard stop surface 102' is brought into contact with second retard stop surface 102, spring 126 will be compressed and piston 128 will be entirely within recess 122. While spring 126 is being compressed, oil is substantially prevented from exiting through bleed hole 134 because bleed hole 134 is covered by second retard stop surface 102. The oil contained between piston 128 and recess 122 is therefore forced out through oil supply orifice 132. In this way, the rate at which torque is applied from electric motor 14 to harmonic gear drive unit 12 is limited by extending the period of time over which the magnitude of torque is increased.

Figure 8:
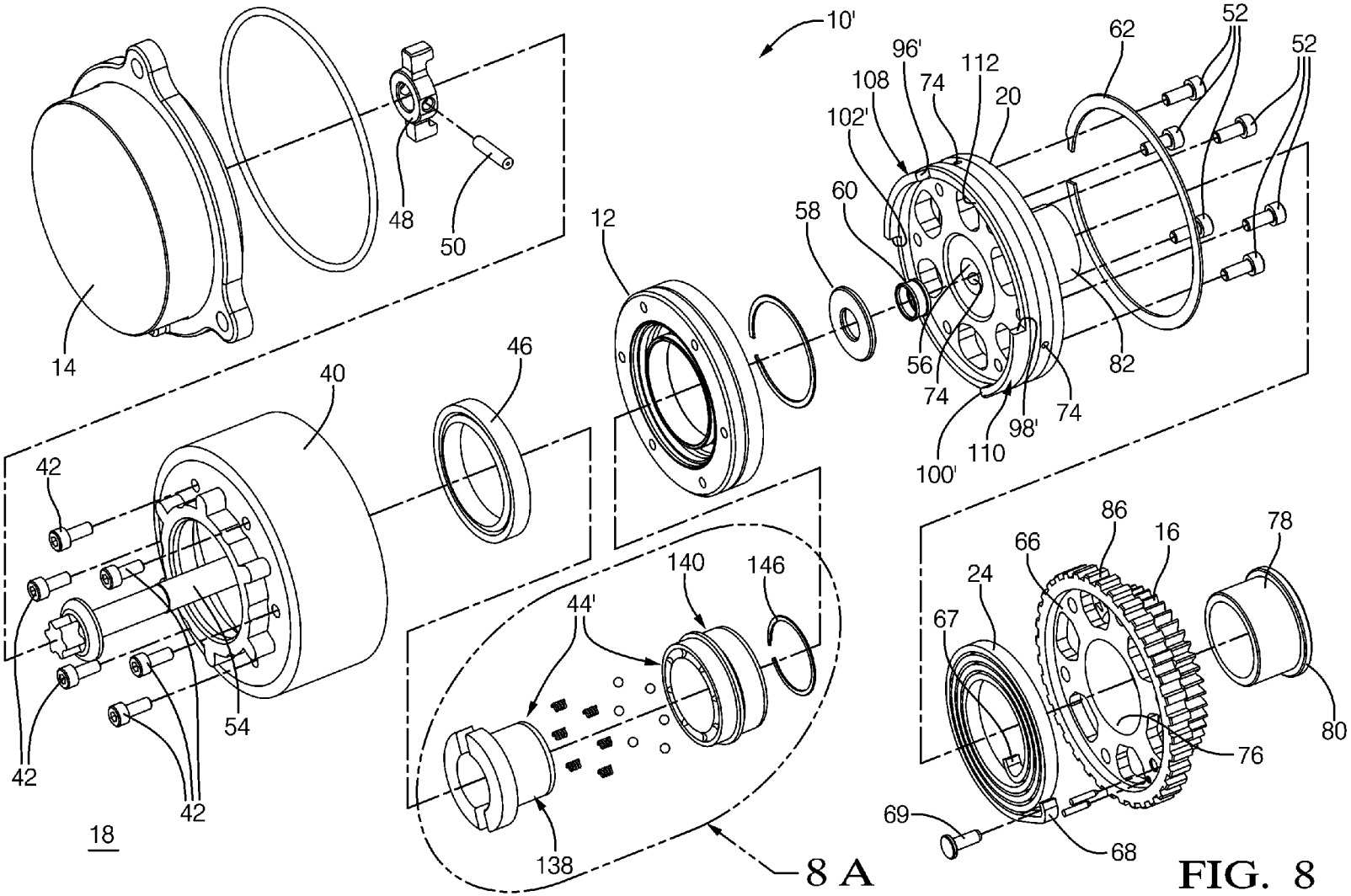
FIG. 8. is an exploded isometric view of a second embodiment eVCP in accordance with the present invention.
Figure 8A:
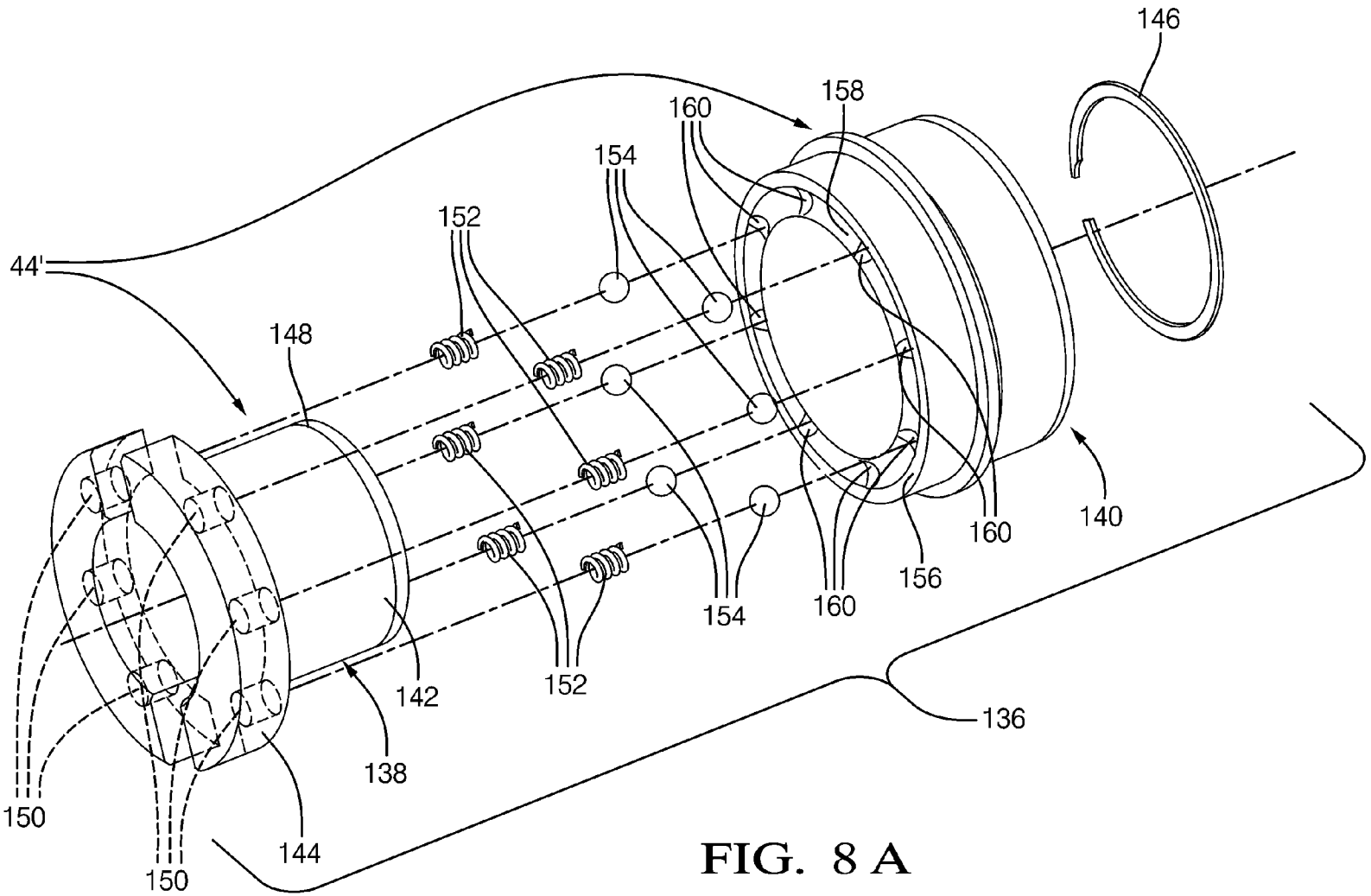
FIG. 8A. is an enlarged exploded isometric view of the clutch of FIG. 8.
Figure 9:
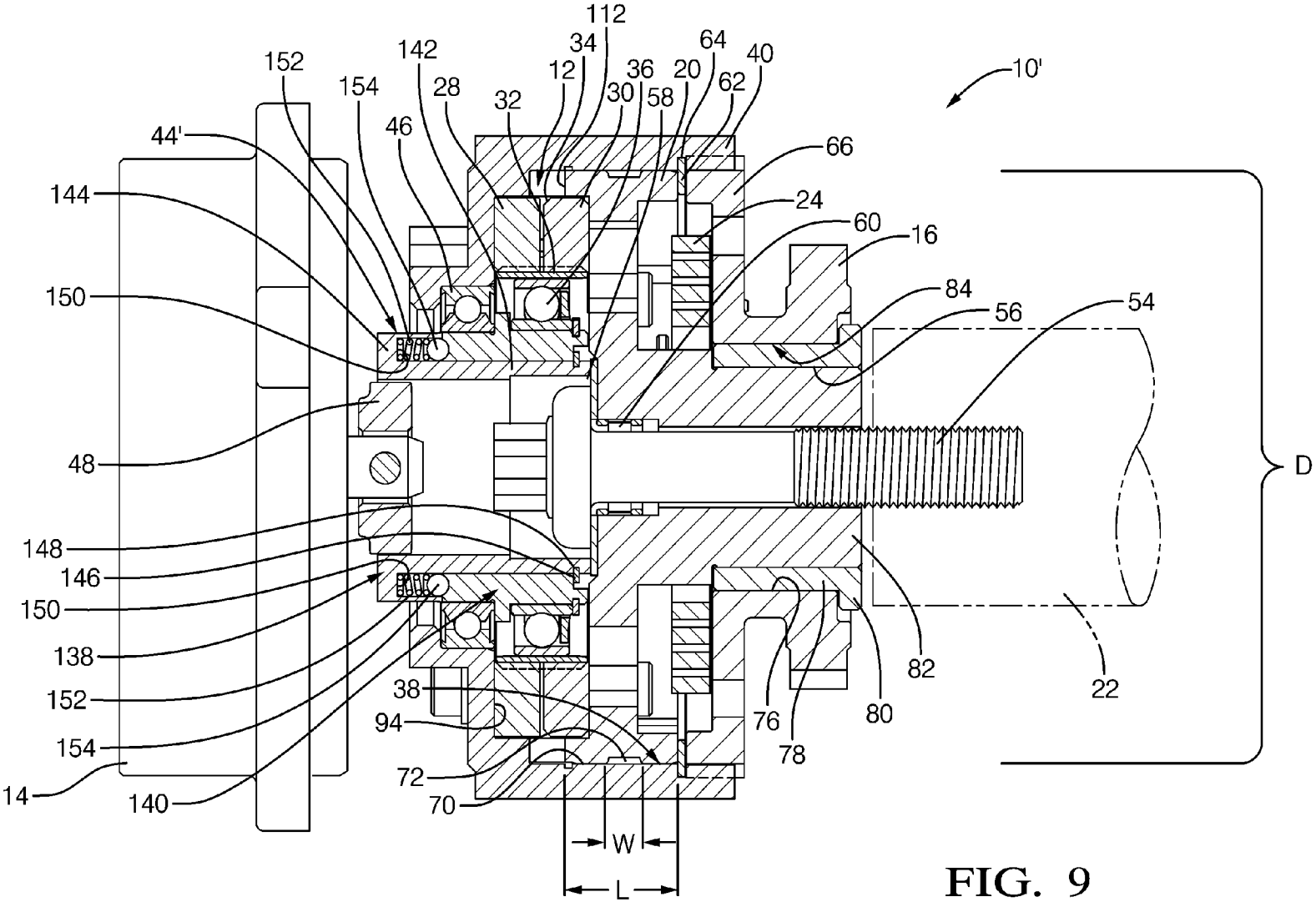
FIG. 9 is an axial cross-section of the eVCP of FIG. 8.

In accordance with a second embodiment of this invention and referring to FIGS. 8, 8A and 9, eVCP 10' is shown substantially the same as eVCP 10 with the exception of the torque absorption means. In eVCP 10', the torque absorption means is not placed directly between corresponding stop surfaces, but instead takes the form of clutch 136. In addition to limiting the rate at which torque is applied from electric motor 14 to wave generator 36 and consequently through harmonic gear drive unit 12, clutch 136 has the added benefit of limiting the amount of torque that can be applied from electric motor 14 to wave generator 36 and consequently through harmonic gear drive unit 12.

In FIGS. 8, 8A, and 9, clutch 136 is embodied as a part of coupling adaptor 44'. Coupling adaptor 44' includes input section 138 and output section 140. Input section 138 includes coupling input hub 142 with flange 144 extending radially outward from the end thereof that is proximal to electric motor 14. Input section 138 rotates in a one-to-one relationship with electric motor 14. Output section 140 is hollow and sized to slidably receive coupling input hub 142 in a close fitting relationship. Output section 140 rotates in a one-to-one relationship with wave generator 36. Coupling input hub 142 may extend through output section 140 and may be retained therein by snap ring 146 which fits into snap ring groove 148 which is formed in the portion of the outer circumference of coupling input hub 142 that extends through output section 140.

Flange 144 includes a plurality of spring pockets 150 extending axially into the face thereof that is proximal to coupling input hub 142. Each spring pocket 150 receives a clutch spring 152 and a clutch ball 154. Clutch springs 152 bias clutch balls 154 outwardly from spring pockets 150 and against output section 140.

Output section 140 includes axial face 156 which is adjacent to flange 144. Axial face 156 includes annular recess 158 having a plurality of detents 160 therewithin that are equiangularly spaced such that each spring pocket 150 is allignable with one detent 160. When detents 160 are aligned with spring pockets 150, each clutch ball 154 is urged into one detent 160. The force exerted by clutch springs 152 allows input section 138 to rotate with output section 140 when electric motor 14 applies a torque below a predetermined value. However, if electric motor 14 applies a torque above the predetermined value, for example when stop members come into contact with each other at the end of angular travel, each clutch ball 154 will compress its respective clutch spring 152. In this way, the rate at which torque is applied from electric motor 14 to harmonic gear drive unit 12 is limited by extending the period of time over which the magnitude of torque is increased. If electric motor 14 continues to apply torque, each clutch ball 154 will move out of its respective detent 160. In this way, input section 138 is allowed to rotate relative to output section 140, and consequently, electric motor 14 is allowed to rotate relative to wave generator 36. When input section 138 rotates relative to output section 140, clutch balls 154 slide within annular recess 158. In this way, the amount of torque that can be applied from electric motor 14 to harmonic gear drive unit 12 is limited.

While clutch 136 is depicted in FIGS. 8 and 8A as having 8 detents 160 and 6 clutch springs/clutch balls 152,154 for engagement therewith, it should now be understood that the number of detents 160 and clutch springs/clutch balls 152, 154 may be designed to allow a desired amount of toque to be applied to clutch 136 from electric motor 14 before relative movement between input section 138 and output section 140 is permitted. It should also be understood that the number of detents 160 could be equal to the number of clutch springs/clutch balls 152, 154.

While the embodiment described herein describes input sprocket 16 as being smaller in diameter than sprocket housing 40 and disposed axially behind sprocket housing 40, it should now be understood that the input sprocket may be radially surrounding the sprocket housing and axially aligned therewith. In this example, the back plate may be press fit into the sprocket housing rather than having a sleeve gear type joint.

While the embodiment described herein includes first and second input stop members, it should now be understood that more or fewer arcuate input stop members may be included. Similarly, more or fewer arcuate output stop members may be included.

While the embodiment described herein describes angular distances $\alpha 1$, $\alpha 2$ of first and second arcuate input stop members 90, 92 as equal and first and second arcuate input stop members 90, 92 are angularly spaced in a symmetric manner, it should now be understood that the first and second arcuate input stop members may be have unequal lengths and may also be spaced asymmetrically. This will result in the first and second arcuate output members being unequal in length and being spaced asymmetrically.

The embodiment described herein describes harmonic gear drive unit 12 as comprising outer first spline 28 which may be either a circular spline or a dynamic spline which serves as the input member; an outer second spline 30 which is the opposite (dynamic or circular) of first spline 28 and which serves as the output member and is coaxially positioned adjacent first spline 28; a flexspline 32 disposed radially inwards of both first and second splines 28, 30 and having outwardly-extending gear teeth disposed for engaging inwardly-extending gear teeth on both first and second splines 28, 30; and a wave generator 36 disposed radially inwards of and engaging flexspline 32. As described, harmonic gear drive unit 12 is a flat plate or pancake type harmonic gear drive unit as referred to in the art. However, it should now be understood that other types of harmonic gear drive units may be used in accordance with the present invention. For example, a cup type harmonic gear drive unit may be used. The cup type harmonic gear drive unit comprises a circular spline which serves as the input member; a flexspline which serves as the output member and which is disposed radially inwards of the circular spline and having outwardly-extending gear teeth disposed for engaging inwardly-extending gear teeth on the circular spline; and a wave generator disposed radially inwards of and engaging the flexspline.

While the invention has been described as a camshaft phaser actuated with an electric motor and using a harmonic gear drive unit, it should now be understood that the invention encompasses camshaft phasers actuated with an electric motor and using any known gear drive units. Other gear drive units that may be used within the scope of this invention include, by non-limiting example, spur gear units, helical gear units, worm gear units, hypoid gear units, planetary gear units, and bevel gear units.

While this invention has been described in terms of preferred embodiments thereof, it is not intended to be so limited, but rather only to the extent set forth in the claims that follow.

We claim:

1. A camshaft phaser for controllably varying the phase relationship between a crankshaft and a camshaft in an internal combustion engine, said camshaft phaser comprising:

a housing having a bore with a longitudinal axis;

a harmonic gear drive unit disposed within said housing, said harmonic gear drive unit comprising a circular spline and an axially adjacent dynamic spline, a flexspline disposed within said circular spline and said dynamic spline, a wave generator disposed within said flexspline, and a rotational actuator connectable to said wave generator such that rotation of said wave generator causes relative rotation between said circular spline and said dynamic spline, wherein one of said circular spline and said dynamic spline is fixed to said housing in order to prevent relative rotation therebetween;

a hub rotatably disposed within said housing axially adjacent to said harmonic gear drive unit and attachable to said camshaft and fixed to the other of said circular spline and said dynamic spline in order to prevent relative rotation therebetween;

a first stop member rotatable with said circular spline in a one-to-one relationship;

a second stop member rotatable with said dynamic spline in a one-to-one relationship for contacting said first stop member to limit relative angular travel between said circular spline and said dynamic spline when said camshaft phaser is phasing said camshaft in one of an advance direction and a retard direction; and a torque absorption means for limiting the rate at which torque is applied from said rotational actuator to said harmonic drive gear unit as said second stop member makes contact with said first stop member.

2. A camshaft phaser as in claim 1 further comprising:

a third stop member rotatable with said circular spline in a one-to-one relationship; and a fourth stop member rotatable with said dynamic spline in a one-to-one relationship for contacting said third stop member to limit relative angular travel between said circular spline and said dynamic spline when said camshaft phaser is phasing said camshaft in the other of said advance direction and said retard direction;

wherein said torque absorption means limits the rate at which torque is applied from said rotational actuator to said harmonic gear drive unit as said fourth stop member makes contact with said third stop member.

3. A camshaft phaser as in claim 1 wherein said torque absorption means includes a compliant and resilient bumper fixed to one of said first stop member and said second stop member.

4. A camshaft phaser as in claim 3 wherein said compliant and resilient bumper is an elastomer.

5. A camshaft phaser as in claim 4 wherein said compliant bumper has a first cross-sectional area and is received within a recess having a second cross-sectional area that is larger than said first cross-sectional area whereby compression of said compliant bumper allows said compliant bumper to expand into said second cross-sectional area.

6. A camshaft phaser as in claim 3 wherein said compliant bumper is a plunger slideable within a bore formed in said one of said first stop member and said second stop member and biased outwardly of said bore by a compression spring.

7. A camshaft phaser as in claim 3 wherein said compliant bumper is a plunger slideable within a bore formed in said one of said first stop member and said second stop member and biased outwardly of said bore by a pressurized fluid.

8. A camshaft phaser as in claim 7 wherein said pressurized fluid is oil used to lubricate said camshaft phaser.

9. A camshaft phaser as is claim 1 wherein said torque absorption means includes a clutch for allowing relative rotation between said rotational actuator and said wave generator when a predetermined torque is applied from said rotational actuator to said wave generator.

10. A camshaft phaser as in claim 9 wherein said clutch includes:

a first surface rotatable with one of said rotational actuator and said wave generator in a one-to-one relationship; and a second surface rotatable with the other of said rotational actuator and said wave generator in a one-to-one relationship and biased into contact with said first surface.

11. A camshaft phaser as in claim 10 where said second surface is biased into contact with said second surface with a coil spring.

12. A camshaft phaser as in claim 11 wherein said second surface is a ball and said first surface includes a detent for receiving said ball.

13. A camshaft phaser as in claim 12 wherein said relative rotation between said rotational actuator and said wave generator causes said ball to compress said coil spring.

14. A camshaft phaser for controllably varying the phase relationship between a crankshaft and a camshaft in an internal combustion engine, said camshaft phaser comprising:

an input member rotatable by said crankshaft an output member rotatable with said camshaft and connected to said input member by a gear drive unit;

a rotational actuator connectable to said gear drive unit whereby rotation of said rotational actuator causes relative rotation between said input member and said output member;

a first stop member rotatable with said input member in a one-to-one relationship;

a second stop member rotatable with said output member in a one-to-one relationship for contacting said first stop member to limit relative angular travel between said input member and said output member; and a torque absorption means for limiting the rate at which torque is applied from said rotational actuator to said gear drive unit as said second stop member makes contact with said first stop member.

15. A camshaft phaser as in claim 14 wherein said torque absorption means includes a compliant and resilient bumper fixed to one of said first stop member and said second stop member.

16. A camshaft phaser as in claim 15 wherein said compliant and resilient bumper is an elastomer.

17. A camshaft phaser as in claim 16 wherein said compliant bumper has a first cross-sectional area and is received within a recess having a second cross-sectional area that is larger than said first cross-sectional area whereby compression of said compliant bumper allows said compliant bumper to expand into said second cross-sectional area.

18. A camshaft phaser as in claim 15 wherein said compliant bumper is a plunger slideable within a bore formed in said one of said first stop member and said second stop member and biased outwardly of said bore by a compression spring.

19. A camshaft phaser as in claim 15 wherein said compliant bumper is a plunger slideable within a bore formed in said one of said first stop member and said second stop member and biased outwardly of said bore by a pressurized fluid.

20. A camshaft phaser as in claim 19 wherein said pressurized fluid is oil used to lubricate said camshaft phaser.

21. A camshaft phaser as is claim 14 wherein said torque absorption means includes a clutch for allowing relative rotation between said rotational actuator and said wave generator when a predetermined torque is applied from said rotational actuator to said wave generator.

22. A camshaft phaser as in claim 21 wherein said clutch includes:

a first surface rotatable with one of said rotational actuator and said wave generator in a one-to-one relationship; and a second surface rotatable with the other of said rotational actuator and said wave generator in a one-to-one relationship and biased into contact with said first surface.

23. A camshaft phaser as in claim 22 where said second surface is biased into contact with said second surface with a coil spring.

24. A camshaft phaser as in claim 23 wherein said second surface is a ball and said first surface includes a detent for receiving said ball.

25. A camshaft phaser as in claim 24 wherein said relative rotation between said rotational actuator and said wave generator causes said ball to compress said coil spring.

* * * * *